US008991353B2

(12) United States Patent
Lewis et al.

(10) Patent No.: US 8,991,353 B2
(45) Date of Patent: Mar. 31, 2015

(54) VALVE SYSTEM

(75) Inventors: James B. Lewis, Novi, MI (US); Hong Wai Nguyen, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 357 days.

(21) Appl. No.: 13/449,893

(22) Filed: Apr. 18, 2012

(65) Prior Publication Data

US 2013/0276728 A1 Oct. 24, 2013

(51) Int. Cl.

| | |
|---|---|
| ***F02N 3/00*** | (2006.01) |
| ***F01L 3/02*** | (2006.01) |
| ***F01L 3/08*** | (2006.01) |
| ***F01L 3/14*** | (2006.01) |

(52) U.S. Cl.

CPC ... *F01L 3/02* (2013.01); *F01L 3/08* (2013.01); *F01L 3/14* (2013.01); *F01L 2101/00* (2013.01); *F01L 2101/02* (2013.01); *F01L 2820/01* (2013.01)

USPC ..... 123/188.3; 123/188.2

(58) Field of Classification Search

USPC ..... 123/188.2, 188.3

See application file for complete search history.

(56) References Cited

U.S. PATENT DOCUMENTS

| | | | | | |
|---|---|---|---|---|---|
| 1,823,452 | A | * | 9/1931 | Heron | 123/188.3 |
| 2,119,042 | A | * | 5/1938 | Charlton | 123/188.3 |
| 2,157,610 | A | * | 5/1939 | Smith | 123/188.3 |
| 2,183,254 | A | * | 12/1939 | Charlton | 123/188.3 |
| 2,274,667 | A | * | 3/1942 | Colwell | 123/188.3 |
| 3,233,599 | A | * | 2/1966 | Schober | 123/188.3 |
| 4,073,474 | A | * | 2/1978 | Hashimoto et al. | 123/188.3 |
| 4,406,046 | A | * | 9/1983 | Adam et al. | 123/188.2 |
| 5,823,158 | A | * | 10/1998 | Heimann et al. | 123/188.3 |

FOREIGN PATENT DOCUMENTS

| | | | |
|---|---|---|---|
| JP | 53013035 | A * | 2/1978 |
| JP | 2012097627 | A * | 5/2012 |

* cited by examiner

*Primary Examiner* — Noah Kamen
(74) *Attorney, Agent, or Firm* — Quinn Law Group, PLLC

(57) ABSTRACT

A valve for an engine cylinder includes a head. The valve is selectively moveable between a closed position in which the head blocks a port and an open position in which the head unblocks the port. A lower stem is formed as one-piece with the head, and a thermal cavity formed within the lower stem. The thermal cavity is at least partially filled with a heat transfer medium. An upper stem is attached to the lower stem opposite the head. A thermal barrier is located adjacent a junction of the lower stem and the upper stem.

16 Claims, 3 Drawing Sheets

VALVE SYSTEM

TECHNICAL FIELD

This disclosure relates to valve systems for internal combustion engines and thermal management thereof.

BACKGROUND

Automobiles and other vehicles utilize internal combustion engines, in which the combustion of a fuel occurs with an oxidizer (usually air) in a cylinder or other combustion chamber. Combustion of the fuel creates heat, some of which is carried away with exhaust products and some of which is absorbed or retained within the engine.

SUMMARY

A valve for an engine cylinder is provided, and includes a head. The valve is selectively moveable between a closed position in which the head blocks a port and an open position in which the head unblocks the port. A lower stem of the valve is formed as one-piece with the head. A thermal cavity is formed within, or defined by, the lower stem. The thermal cavity is at least partially filled with a heat transfer medium.

An upper stem of the valve is attached to the lower stem opposite the head. A thermal barrier is located adjacent a junction of the lower stem and the upper stem.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
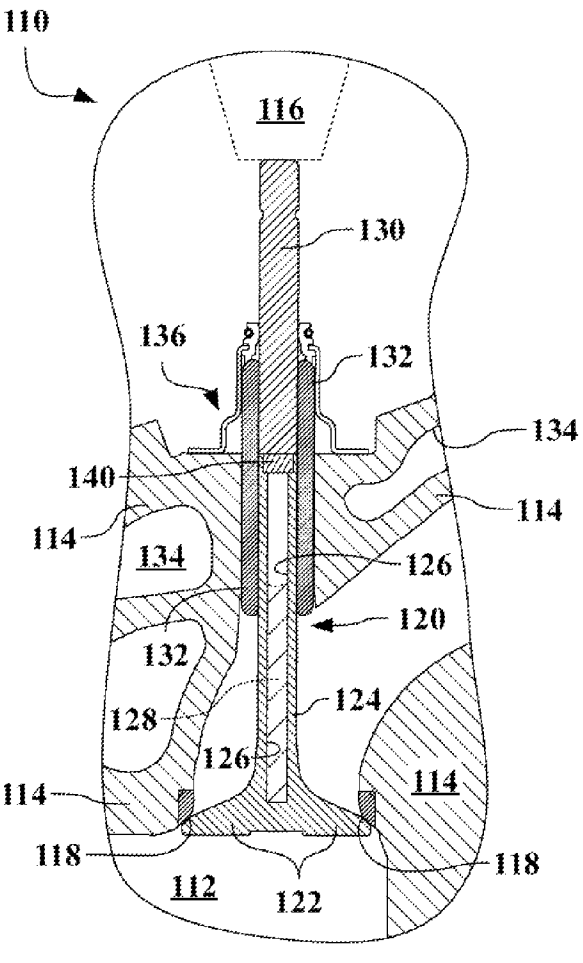
FIG. 1 is a schematic cross-sectional view of portions of a valve system and engine cylinder, showing a thermal barrier in a valve stem.

Referring to the drawings, wherein like reference numbers correspond to like or similar components wherever possible throughout the several figures, there is shown in FIG. 1 a valve system 110, which may be used with various vehicles (not shown) and engines (not shown). FIG. 1 is a cross-sectional view and illustrates some of the features of the valve system 110 and associated structures and functions. However, those having ordinary skill in the art will recognize additional components that may be used with the valve system 110.

While the present invention may be described with respect to automotive applications, those skilled in the art will recognize the broader applicability of the invention. Those having ordinary skill in the art will recognize that terms such as "above," "below," "upward," "downward," et cetera, are used descriptively of the figures, and do not represent limitations on the scope of the invention, as defined by the appended claims. Any numerical designations, such as "first," "second," or "third," are illustrative only and are not intended to limit the scope of the invention in any way.

The valve system 110 is adjacent to a cylinder 112, in which combustion occurs. A housing 114 holds and defines portions of the cylinder 112 and the valve system 110. The housing 114 may be formed from multiple components or may be formed as a single, integral component, such as by casting.

An actuator 116 is configured to selectively allow fluid flow through a port 118 to the cylinder 112. The actuator 116 is shown schematically and may represent many structures, including, without limitation: a rocker, a cam lobe, or a solenoid. The port 118 may be either an intake or an exhaust port.

The valve system 110 includes at least one valve 120. Depending upon the configuration of the engine, there may be a plurality of valves 120 within the valve system 110. For example, the valve system 110 may include four valves 120, with two valves 120 used for intake processes and two valves 120 used for exhaust. Alternatively, each individual valve 120 may have its own valve system 110. For illustrative purposes, only one valve 120 is shown in FIG. 1.

The valve 120 includes a head 122 which is directly adjacent to the cylinder 112 and the port 118. During operation of the engine, the actuator 116 moves the valve 120 between a closed position (shown in FIG. 1) in which the head 122 blocks the port 118 and an open position in which the head 122 unblocks the port 118. The valve 120 generally moves downward (as viewed in FIG. 1) from the illustrated closed position and the open position, in which the valve 120 drops into the cylinder 112 allowing fluid communication through the port 118.

The valve 120 further includes a lower stem 124, which is formed integrally as one-piece with the head 122. However, in other configurations, the head 122 and the lower stem 124 may be separately formed and then attached.

A thermal cavity 126 is formed within the lower stem 124, generally along the length of the lower stem 124 and parallel to the direction of movement of the valve 120. In this configuration, the thermal cavity 126 is at least partially filled with a heat transfer medium 128.

Heat is generated by combustion in the cylinder 112 during operation of the engine, and the head 122 absorbs some of the heat produced by combustion. Portions of the lower stem 124 may also absorb heat produced by combustion, especially when the valve 120 is an exhaust valve.

The heat transfer medium 128 takes heat from the head 122 and the lower portion of the lower stem 124 and carries it upward into the rest of the valve 120. The heat transfer medium 128 may be, for example, sodium or sodium metal. When formed from sodium, the heat transfer medium 128 is inserted into the thermal cavity 126 in solid form, such as pellets. During operation of the engine, the sodium melts and becomes a fluid capable of moving within the thermal cavity 126 and carrying heat from the head 122 and the lower portion of the lower stem 124 to the remainder of the valve 120.

The valve 120 includes an upper stem 130 attached to the lower stem 124 opposite of the head 122. The upper stem 130 may be attached to the lower stem 124 by, for example and without limitation: mechanical mechanisms, welding, adhesives, or combinations thereof.

In the valve system 110, a valve guide 132 surrounds a portion of at least one of the lower stem 124 and the upper stem 130. The valve guide 132 may provide an oiled or lubricated interface between the moving valve 120 and the static housing 114. Alternatively, instead of being formed as a separate component, as shown in FIG. 1, the valve guide 132 may be a portion or surface of the housing 114, such that the valve 120 is in direct contact (along an oiled interface) with the housing 114.

In some configurations, such as that shown in FIG. 1, the valve system 110 includes a water jacket 134 that surrounds portions of the valve guide 132. The water jacket 134 is incorporated into the housing 114 and provides a path for circulation of water or cooling fluids, which are pumped through the water jacket 134. The cooling fluids draw heat from the valve 120 and dissipate that heat elsewhere, such as through a radiator (not shown). In some situations, the water jacket 134 may alternatively be used to warm the valve system 110, such as during engine start-up processes.

A thermal barrier 136 is adjacent to a junction of the lower stem 124 and the upper stem 130. The thermal barrier 136 is configured to block or limit transfer of heat between the lower stem 124—particularly from the heat transfer medium 128—to the upper stem 130. By limiting heat transfer into the upper stem 130, the thermal barrier 136 causes, or allows, heat energy to flow into the housing 114 and the water jacket 134 instead of the upper stem 130. Reducing heat flow to the upper stem 130 may improve performance or durability of the valve system 110.

The thermal barrier 136 in the valve 120 includes a plug 140, which is disposed in the lower stem 124 adjacent to the junction of the lower stem 124 and the upper stem 130. However, the plug 140 may alternatively be disposed in the upper stem 130.

The plug 140 is formed from a ceramic material, such as, without limitation, zirconium oxide or zirconia. The plug 140 has very low thermal conductivity, such that heat carried by the heat transfer medium 128 has difficulty passing the plug 140 and moving further up the valve 120 into the upper stem 130. Note that all materials and material properties described herein are illustrative only.

The remainder of the valve 120 may be formed with different materials from the plug 140. The lower stem 124 may be formed from a first material, and the upper stem 130 may be formed from a second material, different from the first material.

More specifically, and for illustrative purposes only, the first material of the lower stem 124 may be a nickel-chromium alloy or a nickel-chromium-cobalt alloy, such as those sold under the trademarks of NIMONIC or INCONEL. Furthermore, and also for illustrative purposes only, the second material of the upper stem 130 may be a steel alloy, such as AISI M2 steel, or alloys referred to as high speed steel, tool steel, or Molybdenum high speed steel. The nickel-chromium alloy is used for the first material because of its high tensile and creep-rupture properties at temperatures up to 800-1000 Celsius. The nickel-chromium alloy also resists high-temperature corrosion and oxidation.

In the exemplary valve 120 shown in FIG. 1, the first material of the lower stem 124 has lower thermal conductivity than the second material of the upper stem 130. Nickel-chromium alloys have thermal conductivity of approximately 8-14 W/m-K, and M2 steel has a thermal conductivity of approximately 18-30 W/m-K. The plug 140 creates the thermal barrier 136 by having lower thermal conductivity than either the lower stem 124 or the upper stem 130. The illustrative ceramic material forming the plug 140 0.1-1.0 W/m-K, such that the thermal conductivity of the ceramic is likely to be at least one order of magnitude lower than the other materials of the valve 120.

During operation of the valve system 110—when the temperatures are high—heat produced during combustion in the cylinder 112 is transferred to the head 122 of the valve 120. That heat is carried from the head 122 up the lower stem 124 by the heat transfer medium 128. The plug 140 blocks (or at least limits) heat transfer from the lower stem 124 to the upper stem 130. Therefore, heat from the lower stem 124 is conducted through the valve guide 132 into the housing 114 and the water jacket 134.

In the valve 120 shown in FIG. 1, the plug 140 has a cylindrical shape, but the valve 120 may use other shapes, including frustoconical or spherical shapes for the plug 140. In this configuration, the plug 140 may also be used to close the thermal cavity 126 after the heat transfer medium 128 is added during assembly. Although the plug 140 is shown embedded within the lower stem 124, the plug 140 may also be a wider cylindrical disc on top of (as viewed in the figure) the lower stem 124, such that the plug 140 is completely between the lower stem 124 and the upper stem 130.

Figure 2:
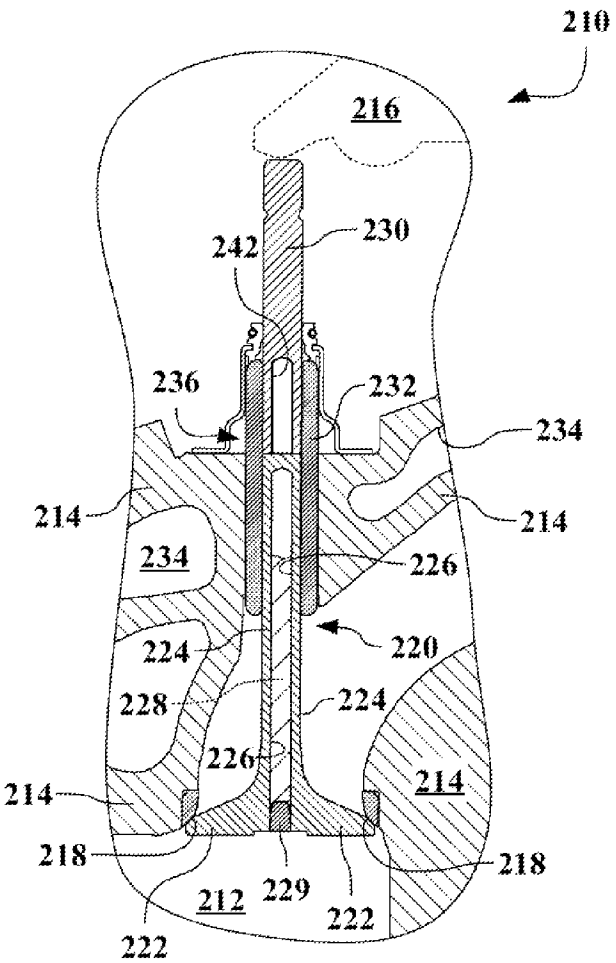
FIG. 2 is a schematic cross-sectional view of portions of a valve system having another thermal barrier.

Referring now to FIG. 2, and with continued reference to FIG. 1, there is shown a cross-sectional view of a valve system 210, which may be used with many different engines. The valve system 210 interacts with a cylinder 212 disposed within a housing 214. An actuator 216 is configured to selectively allow fluid flow through a port 218 to the cylinder 212.

The actuator 216 shown is a rocker, which acts on the top (as viewed in FIG. 2) of a valve 220. A head 222 of the valve 220 is selectively moveable between a closed position in which the head 222 blocks the port 218 and an open position in which the head 222 unblocks the port 218. A lower stem 224 is formed as one-piece with the head 222.

A thermal cavity 226 is formed within the lower stem 224. Again, the thermal cavity 226 is at least partially filled with a heat transfer medium 228, such as sodium. In the valve 220, the heat transfer medium 228 is retained within the thermal cavity 226 by a cavity plug 229 inserted through the head 222.

The valve 220 also includes an upper stem 230 attached to the lower stem 224 opposite from the head 222. A valve guide 232 may surround portions of the upper stem 230 and the lower stem 224. The housing 214 may include a water jacket 234 or other heat sinks A thermal barrier 236 is adjacent a junction of the lower stem 224 and the upper stem 230.

Unlike the valve 120 shown in FIG. 1, the thermal barrier 236 of the valve 220 does not include a ceramic plug. The valve 220 includes a hollow chamber 242 formed in the upper stem 230 adjacent to the junction with the lower stem 224. The hollow chamber 242 forms the thermal barrier 236 by using air within the hollow chamber 242 as an insulating region.

In some configurations of the valve 220, the hollow chamber 242 includes at least a partial vacuum. With a partial, or full, vacuum in the hollow chamber 242, the thermal conductivity of the upper stem 230 adjacent to the lower stem 224 is further reduced. The thermal barrier 236 may be further improved in the valve 220 by including a reflective coating substantially covering the hollow chamber 242. The reflective coating may reduce radiant heat transfer from the lower stem 224 to the upper stem 230 through the hollow chamber 242.

The lower stem 224 and the upper stem 230 of the valve 220 may also be formed from different materials. For example, the lower stem 224 may be formed from a first material, which may be a nickel-chromium alloy, and the upper stem 230 may be formed from a second material, which may be a steel alloy, such as M2 high speed steel.

During operation of the valve system 210—when the temperatures are high—heat produced during combustion in the cylinder 212 is transferred to the head 222 of the valve 220. Heat is carried from the head 222 up the lower stem 224 by the heat transfer medium 228, and also by the walls of the lower stem 224. The hollow chamber 242 blocks (or at least limits) heat transfer from the lower stem 224 to the upper stem 230. Therefore, heat from the lower stem 224 is conducted through the valve guide 232 into the housing 214 and the water jacket 234 instead of moving further upward.

Figure 3:
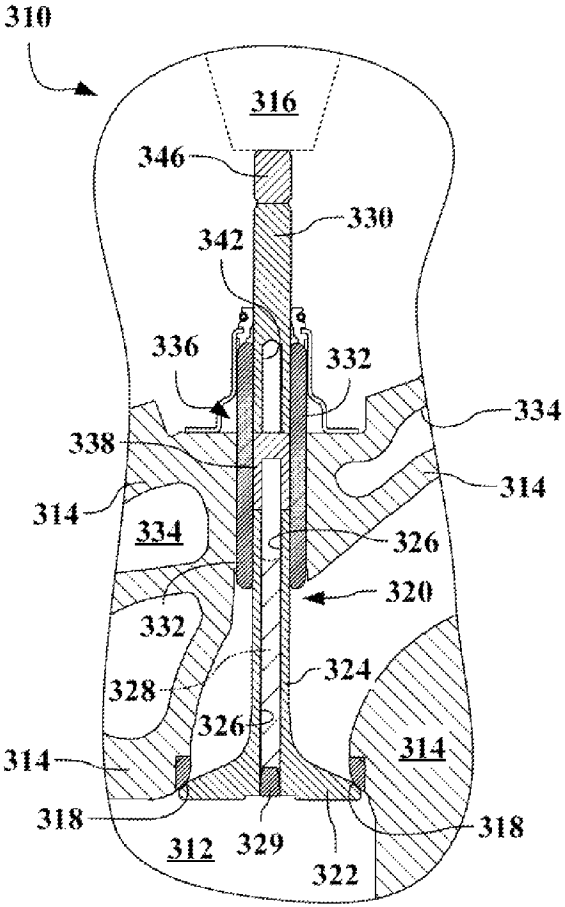
FIG. 3 is a schematic cross-sectional view of portions of a valve system having another thermal barrier and a high-conductivity mid stem.

Referring now to FIG. 3, and with continued reference to FIGS. 1-2, there is shown a cross-sectional view of a valve system 310, which may be used with many different engines. The valve system 310 works with a cylinder 312 disposed within a housing 314. An actuator 316 is configured to selectively allow fluid flow through a port 318 to the cylinder 312.

A head 322 of the valve 320 is selectively moveable between a closed position in which the head 322 blocks the port 318 and an open position in which the head 322 unblocks the port 318. A lower stem 324 is formed as one-piece with, or attached to, the head 322.

A thermal cavity 326 is formed within the lower stem 324, and is at least partially filled with a heat transfer medium 328, such as sodium. In the valve 320, the heat transfer medium 328 is retained within the thermal cavity 326 by a cavity plug 329 inserted through the head 322. The valve 320 also includes an upper stem 330 opposite the lower stem 324 from the head 322.

A valve guide 332 may surround portions of the upper stem 330 and the lower stem 324. The housing 314 may include a water jacket 334 or other heat sinks A thermal barrier 336 is formed in a portion of the upper stem 330.

The valve 320 further includes a mid stem 338 or middle stem portion attached to the lower stem 324 between the lower stem 324 and the upper stem 330. The mid stem 338 forms a portion of the thermal cavity 326, but is otherwise similar to the upper portions of the lower stem 324.

In the valve 320, the lower stem 324 is formed from a first material, such as a nickel-chromium alloy. The mid stem 338 is formed from a second material different from the first material. For example, the mid stem 338 may be formed from high speed steel, which has higher thermal conductivity than the nickel-chromium alloy of the lower stem 324.

The valve 320 includes a hollow chamber 342 formed in the upper stem 330 adjacent to the junction with the lower stem 324. The hollow chamber 342 forms the thermal barrier 336 by using air within the hollow chamber 342 as an insulating region. The upper stem 330 may also be formed from the first material, nickel-chromium alloy, such that the lower stem 324 and the upper stem 330 are formed from similar materials.

In some configurations of the valve 320, the hollow chamber 342 includes at least a partial vacuum. With a partial, or full, vacuum in the hollow chamber 342, the thermal conductivity of the upper stem 330 adjacent to the mid stem 338 is further reduced. The thermal barrier 336 may be further improved in the valve 320 by including a reflective coating substantially covering the hollow chamber 342. The reflective coating may reduce radiant heat transfer from the mid stem 338 to the upper stem 330 through the hollow chamber 342.

The valve 320 has a wear cap 346 attached to the upper stem 330 between the upper stem 330 and the actuator 316. However, the wear cap 346 is not formed from the first material. For example, the wear cap 346 may be formed from the same material as the mid stem 338 (M2 high speed steel) or another material, and may be formed from a material that is more wear resistant than the nickel-chromium alloy.

During steady state operation of the valve system 310—when the temperatures are high—heat produced during combustion in the cylinder 312 is transferred to the head 322 of the valve 320. Heat is carried from the head 322 up the lower stem 324 by the heat transfer medium 328, and also by the walls of the lower stem 324. The hollow chamber 342 blocks (or at least limits) heat transfer from the lower stem 324 to the upper stem 330. Therefore, heat from the lower stem 324 is conducted through the valve guide 332 into the housing 314 and the water jacket 334 instead of moving further upward.

Figure 4:
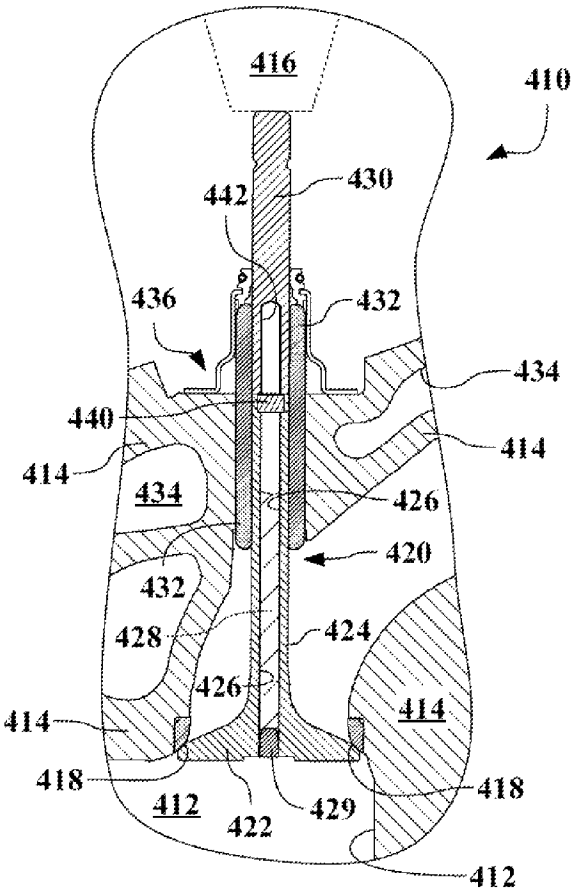
FIG. 4 is a schematic cross-sectional view of portions of a valve system having another thermal barrier.

Referring now to FIG. 4, and with continued reference to FIGS. 1-3, there is shown a cross-sectional view of a valve system 410, which may be used with many different engines. The valve system 410 works with a cylinder 412 disposed within a housing 414. An actuator 416 is configured to selectively allow fluid flow through a port 418 to the cylinder 412.

A head 422 of the valve 420 is selectively moveable between a closed position in which the head 422 blocks the port 418 and an open position in which the head 422 unblocks the port 418. A lower stem 424 is formed as one-piece with, or attached to, the head 422.

A thermal cavity 426 is formed within the lower stem 424. The thermal cavity 426 may be at least partially filled with a heat transfer medium 428, such as sodium. The heat transfer medium 428 may be retained within the thermal cavity 426 by a cavity plug 429.

The valve 420 also includes an upper stem 430 attached to the lower stem 424 opposite from the head 422. A valve guide 432 may surround portions of the upper stem 430 and the lower stem 424. The housing 414 may include a water jacket 434 or other heat sinks A thermal barrier 436 is adjacent a junction of the lower stem 424 and the upper stem 430.

The thermal barrier 436 of the valve 420 includes a plug 440, which may be a ceramic plug. Additionally, the thermal barrier 436 includes a hollow chamber 442 formed in the upper stem 430 adjacent to the junction with the lower stem 424 and the plug 440. The hollow chamber 442 and the plug 440 combine to form the thermal barrier 436 by using air within the hollow chamber 442 as an insulating region and using the very low conductivity of the plug 440 to further insulate.

In FIG. 4, the plug 440 has a frustoconical shape, but may use other shapes, including cylindrical or spherical shapes for the plug 440. In some configurations of the valve 420, the hollow chamber 442 includes at least a partial vacuum. With a partial, or full, vacuum in the hollow chamber 442, the thermal conductivity of the upper stem 330 adjacent to the lower stem 424 is further reduced. The thermal barrier 436 may be further improved in the valve 420 by including a reflective coating substantially covering the hollow chamber 442.

The lower stem 424 and the upper stem 430 of the valve 420 may also be formed from different materials. For example, the lower stem 424 may be formed from a first material, which may be a nickel-chromium alloy, and the upper stem 430 may be formed from a second material, which may be a steel alloy, such as M2 high speed steel.

Heat produced during combustion in the cylinder 412 is carried from the head 422 up the lower stem 424 by the heat transfer medium 428, and also by the walls of the lower stem 424. The plug 440 and the hollow chamber 442 block or limit heat transfer from the lower stem 424 to the upper stem 430. Therefore, heat from the lower stem 424 is conducted through the valve guide 432 into the housing 414 and the water jacket 434 instead of moving further upward the upper stem 330.

Figure 5:
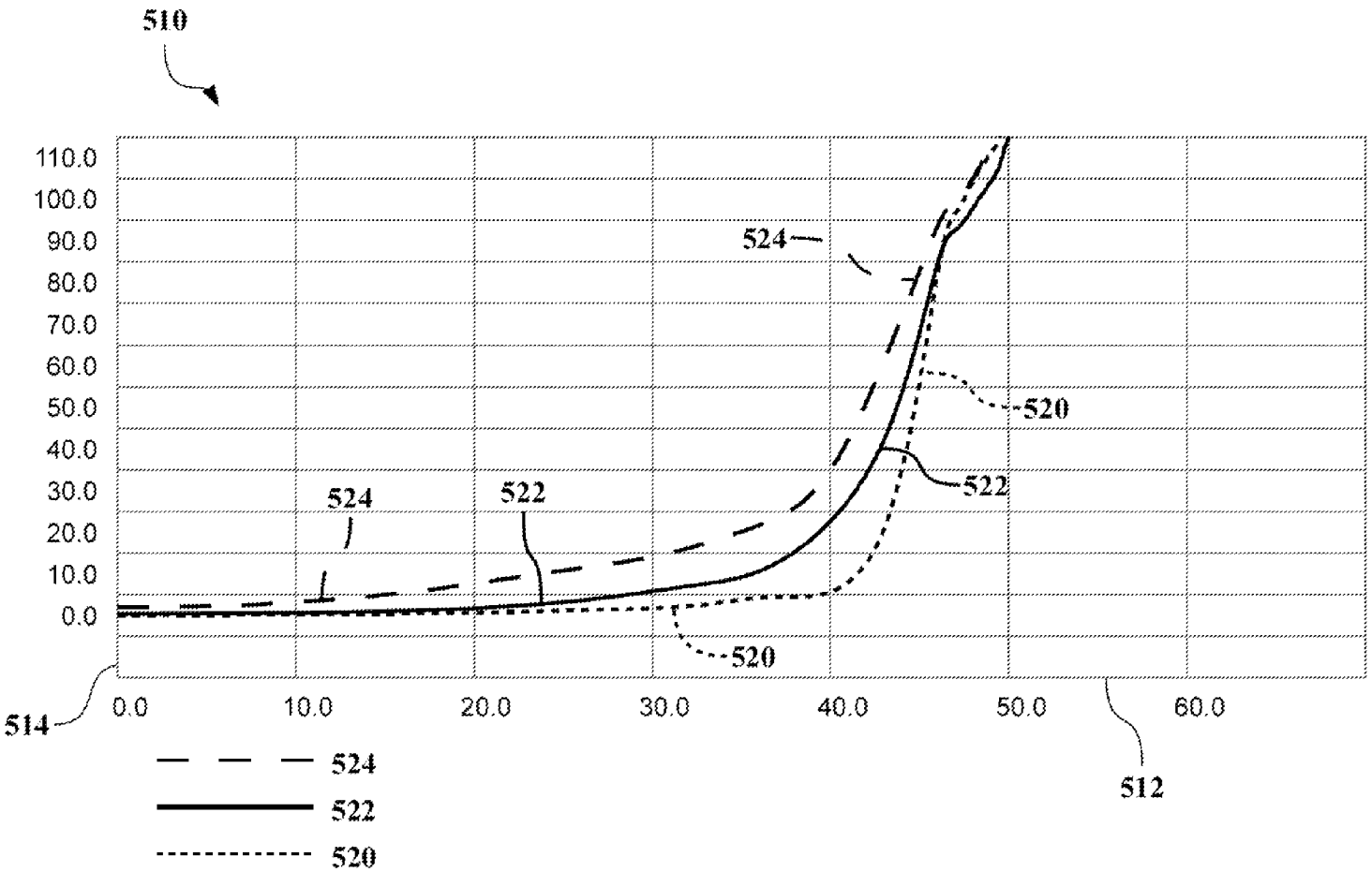
FIG. 5 is a schematic chart illustrating heat transfer through three illustrative valves.

Referring now to FIG. 5, and with continued reference to FIGS. 1-4, there is shown a schematic chart 510, which graphs simulated operating temperatures of three illustrative valves. The chart 510 shows distance (in millimeters) from a tip of the illustrative valve along an x-axis 512, and shows temperature differential (in degrees Celsius) along a y-axis 514.

The distance shown along the x-axis 512 is measured from the upper-most tip of the valves, at the interface with the actuator. As the values along the x-axis 512 move toward zero, it is less desirable for large temperature differentials to exist between.

A response line for a first valve 520 illustrates heat transfer through a valve having a ceramic plug. The first valve 520 may be substantially similar to the valve 120 shown in FIG. 1. A response line for a second valve 522 illustrates heat transfer through a valve having a hollow chamber. The second valve 522 may be substantially similar to the valve 220 shown in FIG. 2.

A response line for a third valve 524 illustrates heat transfer through a valve having neither a plug nor a hollow chamber. The third valve 524 has a lower stem formed from nickel-chromium alloy and is substantially similar to the lower stem 224 shown in FIG. 2. An upper stem of the third valve 524 is formed from M2 high speed steel and is substantially similar to the upper stem 130 shown in FIG. 1. The other components of the simulated valves shown in the chart 510 are identical.

In each of the illustrated valves, the upper portion of the sodium-filled thermal cavity was at approximately 45 millimeters from the tip of the valves. The values shown in the chart 510 illustrate the different simulated responses of the respective valves during steady state operation, but are not limiting of the invention.

As shown in the chart 510, the temperature of the second valve 522 is reduced along most of its length relative to the third valve 524, indicating that valves with a hollow chamber reduce temperature relative to valves without a hollow chamber. Similarly, the temperature of the first valve 520 is reduced along most of its length relative to the third valve 524, indicating that valves with a ceramic plug reduce temperatures relative to valves without. The first valve 520 shows the lowest temperature profile of the three, indicating that the first valve 520 performed better than the second valve 522 or the third valve 524 in this simulation of heat transfer.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A valve for an engine cylinder, comprising:
- a head, wherein the valve is selectively moveable between a closed position in which the head blocks a port and an open position in which the head unblocks the port;
- a lower stem formed as one-piece with the head;
- a thermal cavity formed within the lower stem, wherein the thermal cavity is at least partially filled with a heat transfer medium;
- an upper stem attached to the lower stem opposite the head;
- a thermal barrier adjacent a junction of the lower stem and the upper stem; and
- a plug disposed in one of the lower stem and the upper stem adjacent to the junction, wherein the plug forms the thermal barrier, wherein the plug is formed from a ceramic material.

2. The valve of claim 1, wherein the plug has one of a cylindrical and a frustoconical shape.

3. The valve of claim 1, further comprising:
- a hollow chamber formed in the upper stem adjacent to the junction, wherein the hollow chamber forms the thermal barrier.

4. The valve of claim 3, wherein the hollow chamber includes at least a partial vacuum.

5. The valve of claim 4,
- wherein the lower stem is formed from a first material and the upper stem is formed from a second material, different from the first material, and
- wherein the first material is a nickel-chromium alloy and the second material is a steel alloy.

6. The valve of claim 5, further comprising:
- a reflective coating substantially covering the hollow chamber.

7. The valve of claim 1,
- wherein the lower stem is formed from a first material,
- wherein the upper stem is formed from a second material, different from the first material, and
- wherein the first material has lower thermal conductivity than the second material.

8. A valve for an engine cylinder, comprising:
- a head, wherein the valve is selectively moveable between a closed position in which the head blocks a port and an open position in which the head unblocks the port;
- a lower stem formed as one-piece with the head;
- a thermal cavity formed within the lower stem, wherein the thermal cavity is at least partially filled with a heat transfer medium;
- an upper stem attached to the lower stem opposite the head, wherein the lower stem is formed from a nickel-chromium alloy and the upper stem is formed from a steel alloy;
- a thermal barrier adjacent a junction of the lower stem and the upper stem;
- a hollow chamber formed in the upper stem adjacent to the junction, wherein the hollow chamber includes at least a partial vacuum and forms the thermal barrier; and
- a reflective coating substantially covering the hollow chamber.

9. The valve of claim 8, comprising:
- a plug disposed in one of the lower stem and the upper stem adjacent to the junction, wherein the plug forms the thermal barrier and is formed from a ceramic material.

10. The valve of claim 8, wherein the lower stem and the upper stem are formed from a first material, and the valve further includes:
- a mid stem portion attached to the lower stem between the lower stem and the upper stem, wherein the mid stem forms a portion of the thermal cavity, is formed from a second material different from the first material, and the first material has lower thermal conductivity than the second material.

11. The valve of claim 10, comprising:
- a plug disposed in one of the mid stem and the upper stem adjacent to the junction, wherein the plug forms the thermal barrier and is formed from a ceramic material.

12. A valve system, comprising:
- a valve, including:
  - a head;
  - a lower stem formed as one-piece with the head;
  - a thermal cavity formed within the lower stem, wherein the thermal cavity is at least partially filled with a heat transfer medium;
  - an upper stem attached to the lower stem opposite the head, wherein the upper stem is formed as a separate piece from the lower stem, wherein the lower stem and the upper stem are formed from a first material;
  - a mid stem portion attached to the lower stem between the lower stem and the upper stem, wherein the mid stem forms a portion of the thermal cavity, is formed from a second material different from the first material, and the first material has lower thermal conductivity than the second material; and a thermal barrier adjacent to a junction of the lower stem and the upper stem;

a hollow chamber formed in the upper stem adjacent to the junction, wherein the hollow chamber forms the thermal barrier;

a valve guide surrounding a portion of at least one of the lower stem and the upper stem; and an actuator configured to selectively move the valve between a closed position in which the head blocks a port and an open position in which the head unblocks the port.

13. The valve system of claim 12, wherein the valve further includes:

a wear cap between the upper stem and the actuator, wherein the wear cap is not formed from the first material.

14. The valve system of claim 12, wherein the valve further includes:

a plug disposed in one of the mid stem and the upper stem adjacent to the junction, wherein the plug and the hollow chamber both form the thermal barrier.

15. The valve system of claim 14, further comprising:

a reflective coating substantially covering the hollow chamber.

16. The valve system of claim 12, further comprising:

a reflective coating substantially covering the hollow chamber.

* * * * *